US007497245B2

(12) United States Patent
Lorentz et al.

(10) Patent No.: US 7,497,245 B2
(45) Date of Patent: Mar. 3, 2009

(54) DETECTION SYSTEM FOR LOCALIZING DEFECTIVE SEALS IN HEAT EXCHANGERS

(75) Inventors: Jay Lorentz, Shelbyville, IN (US); Stephen J. Gunn, Indiannapolis, IN (US)

(73) Assignee: Valeo, Inc., Auburn Hills, MI (US)

( * ) Notice: Subject to any disclaimer, the term of this patent is extended or adjusted under 35 U.S.C. 154(b) by 502 days.

(21) Appl. No.: 10/881,551

(22) Filed: Jun. 30, 2004

(65) Prior Publication Data

US 2006/0000589 A1 Jan. 5, 2006

(51) Int. Cl.
*F22B 27/00* (2006.01)

(52) U.S. Cl. ..... 165/11.1; 165/70; 165/173

(58) Field of Classification Search ..... 165/11.1, 165/70, 173

See application file for complete search history.

(56) References Cited

U.S. PATENT DOCUMENTS 4,368,694 A 1/1983 Ward et al.
4,997,035 A 3/1991 Beatenbough et al.
5,267,275 A 11/1993 Lamoureux
5,607,012 A 3/1997 Buchanan et al.
5,899,267 A 5/1999 Kroetsch et al.
6,942,014 B2 * 9/2005 Bonnet ..... 165/11.1

FOREIGN PATENT DOCUMENTS

DE 35 44 588 6/1987
JP 60 023790 A 6/1985

* cited by examiner

*Primary Examiner*—Ljiljana (Lil) V Ciric
(74) *Attorney, Agent, or Firm*—Dierker & Associates, P.C.

(57) ABSTRACT

A heat exchanger assembly includes a core with a header, an end tank and a joint between the header and the end tank. A seal between the header and the end tank is in an area at the joint between the header and the end tank. The seal normally produces a permanent seal except when a misalignment of the seal at the joint between the header and the end tank produces a temporary seal. At least one groove or channel is defined in the header or the end tank at the joint between the header and the end tank, for detecting the temporary seal. The at least one groove or channel extends beyond a highest point at which the temporary seal is formed. The groove or channel functions as a positive leak path between the temporary seal and the header and/or the end tank in the area at the joint between the header and the end tank.

13 Claims, 12 Drawing Sheets

DETECTION SYSTEM FOR LOCALIZING DEFECTIVE SEALS IN HEAT EXCHANGERS

FIELD OF INVENTION

The present invention relates to the field of automotive heat exchanger assemblies, and, in particular, heat exchangers with tank and header assemblies and seals between such assemblies. The present invention also relates to a method of making a positive leak path to determine and localize eventual leaks prior to customer assembly plant testing or end customer usage of the heat exchanger.

BACKGROUND OF THE INVENTION

Automotive heat exchanger assemblies commonly have a core comprising tubes, separators or fins, and side plates made of some type of metal, such as aluminum, and associated headers. These heat exchangers also comprise end tanks or manifolds made of plastic or metal. The purpose of the header is to attach the end tank or manifold firmly to the core portion of the heat exchanger. To provide for efficient heat exchange and to avoid potentially overheating due to loss of thermal liquid or gas within the heat exchanger, the tank to header joints must be essentially leak-proof. Typically the tank to header joints are made 'leak tight' by providing for a seal, such as a rubber gasket, between the header and the tank.

The problem with current designs is that the gasket, and, in particular, the rubber gasket often used between the header and the tank, is often misaligned or otherwise improperly positioned, either due to improper assembly procedures or faulty design of seal or gasket. Such a misalignment or 'defect' is often not detectable at the first stages of assembly or testing, due to the fact that the location of the seal is not visible on external examination. Detection of the defect is made more difficult since the seal, though defective, may make the tank to header joint appear to be leak proof and the heat exchanger may appear to be functioning properly, due to the fact that the misalignment or otherwise improper positioning of the gasket lead to it somehow being 'wedged' or 'pinched' in place during assembly, leading to the formation of a temporary seal. Since this temporary seal may be capable of lasting through traditional leak testing procedures performed after initial assembly at the manufacturing facility, the fact that it is defective vis-à-vis its use in the normal heat exchanger operating environment, may not be apparent until the heat exchanger is shipped to a customer assembly plant for further processing, or even during vehicle use by the end customer, which can lead to disastrous consequences.

One approach to solving this problem is illustrated in U.S. Pat. No. 5,899,267, which adds ribs which project from the interior wall of the end tank in order to hold in a gasket that is incorrectly positioned so that it can form a seal, while nevertheless, allowing the defective or not properly assembled joint gasket to exist and to hold back or contain fluid. The ribs may also prevent an inappropriately positioned gasket from being displaced during initial leak testing, to prevent the catastrophic loss of fluid. In addition, inappropriately positioned and/or pinched gaskets can have resultant tears and/or induced gasket surface defects or flaws, that reduce the life of the seal, and, thus, the effective lifetime of the heat exchanger assembly. The solution of U.S. Pat. No. 5,899,267 may, therefore, lead to the unexpected effect of shipping parts, with improperly positioned gaskets and/or other defects or flaws, to the customer or end consumer.

The heat exchanger assemblies of the present invention, with means to detect temporary seals at the tank to header joint, as described below, have not been described in this prior art.

SUMMARY OF THE INVENTION

The present invention relates to a heat exchanger comprising a core, a header, end tanks, and a tank to header joint, wherein the tank to header joint comprises a seal, and, in particular, a seal formed by a sealing means such as a gasket, and the end tank or header further comprises at least one means for detecting a temporary seal, preferably a channel or groove, and, preferably, a plurality of channels or grooves.

The one or more than one (plurality) of channels or grooves is designed to create a leak path (positive leak path) so that an inappropriate, incomplete or 'temporary seal' can be detected upon testing, even where it is not visibly identified during or just after its initial manufacture. The channel or groove (or channels or grooves) is located preferably on the end tank or the header, more preferably on the interior surface of the end tank or core's header, even more preferably on the end tank, or, when more than plurality of channels or grooves is present, one or more channels or grooves on both the interior surface of the end tank and the header.

In preferred embodiments of the present invention, the channels or grooves on the interior of the end tank or the core's header form a positive leak path which is visible on the interior of the end tank or on the interior or the fluid side, (e.g. coolant, water, air or other fluid side) of the header, and can be easily seen by the naked eye when unassembled. The form or shape of the channels or grooves can be straight, curved, sinusoidal or any other shape that meets the criteria of providing a positive leak path when the sealing means is misaligned or otherwise malpositioned. When a gasket is placed into the 'proper' location, it forms a seal that is leak proof all around the tank to header joint. When the gasket is misaligned or otherwise improperly positioned at the tank to header joint, the fact that the seal is not 'leak tight' or 'leak proof' becomes apparent, (e.g. in underwater dunk, liquid fill, pressure decay, helium mass spectrometer, or other testing) due to the leakage around the defective point of the gasket via the positive leak path.

The channel or groove or channels or grooves of the present invention, preferably, extend from the base of the tank foot to above the level of the gasket in its proper position at the tank to header joint. Preferably, the means of detecting a temporary seal, and more preferably, the channel or groove, extends above the highest point at which an improper seal can be formed between the header and the tank. In geometric terms, the channel or groove or channels or grooves extend up to or above the highest point where a line of tangency still can exist between both the header and gasket and gasket and the end tank.

In preferred embodiments of the present invention, a leak test material, i.e. a so called 'fluid' of either a gaseous or liquid nature, is used to test the location of the seal means or gasket in the tank to header joint. Examples of such a fluid include water, air, helium, nitrogen, carbon dioxide, etc. The fluid, by bypassing or flowing by the area of the seal at the tank to header joint, enters into the channels or grooves on the interior surface of the end tank and/or header and escapes at the level of contact of the channel or groove with the normally liquid containing interior environment. In general terms, the channel or groove can be characterized as extending from an area open and in contact with the internal liquid containing environment of the tank. In other words, when the sealing means, such as a gasket, is misaligned, the means for detecting a temporary seal, such as a groove or grooves or channels, serve as a type of "connection" between the inside or interior of the heat exchanger to the outside or exterior of the heat exchanger, allowing fluid to escape. If the sealing means is properly aligned, the grooves or channels remain totally 'covered' or 'blocked' within the heat exchanger, and no fluid escape at the tank to header joint area occurs.

The present invention further provides for a method of detecting leaks in the tank to header joint comprising the steps of providing a sealing means, e.g. a gasket, on, preferably, the inner surface of the header or the end tank, or on both, and, assembling a header to end tank joint comprising a means for detecting a temporary seal between the header and end tank. The sealing means may be positioned prior to final assembly, in the joint or provided in conjunction with or as part of, one of the pieces making up the header joint (e.g. the tank, tank foot, or header). A preferred method of the present invention is, therefore, a method for detecting temporary seals in heat exchanger assemblies having a core with headers and end tanks at the area of the tank to header joint comprising: providing a sealing means for forming a normally leak proof seal at the tank to header joint between a header and an end tank; passing a test fluid through the heat exchanger core which passes by the area of the normally leak proof seal at the tank to header joint; providing a positive leak path comprising a means for detecting temporary seals such as a channel or groove or the like on the interior surface of the end tank or header in the area of the normally leak proof seal; and examining for evidence of test fluid leakage through the positive leak path indicating a improper, incomplete or temporary seal in the normally leak proof seal area.

The present invention further relates to a method of making a positive leak path to determine incomplete or temporary seals, prior to final shipment of quality-verified heat exchanger assemblies. This aspect of the present invention allows the creation of a positive leak path that will be sealed if the sealing means, such as a gasket is properly positioned in the space between the tank and the header, preferably flush with the tank and, in particular, the tank foot. The leak path extends from the tank, preferably at the tank foot at least up to, but preferably above, the point of the tank where the mal-positioned gasket can form a temporary 'leak tight' or 'leak proof' seal.

The present invention, in all its embodiments, results, thereby, in markedly better detection of 'non-conforming' or future 'leaking' heat exchanger assemblies, especially heat exchanger assemblies having a core comprising a header and tanks attached to the core at the header in a way to form a tank to header leak proof seal, that reduces or eliminates the occurrence of 'non-conforming' or future 'leaking' assemblies reaching the customer in less than optimal condition for performance, by detecting leaks at the initial assembly manufacture stage.

As used in the present specification, a permanent seal is, therefore, a seal which is designed to withstand pressure, temperature, chemicals and/or other conditions encountered during the expected, normal 'lifetime' of the product, e.g. the life of a heat exchanger. A 'temporary' seal is, therefore, a seal usually inadvertently produced that would not be designed for and/or expected to last the lifetime of the product. The present invention solves the problem of detecting temporary seals, and, in particular, undesirable seals formed by sealing means, such as gaskets, and, in particular, rubber or plastic, or rubber-like or plastic-like gaskets, which may lead to false positive results and resultant failures of assemblies due to non detection of potential future leakages. Therefore, a positive leak would indicate the presence of an incorrect or improperly located gasket that does not adequately seal or temporarily seals at the tank to header joint area.

The present invention provides distinct advantages for tank to header joints employing seals. For heat exchangers, defective or 'temporarily-sealed' assemblies, that might normally pass ordinary leak tests used in the industry, can be detected and contained within the manufacturing plant, reducing or eliminating customer returns.

In preferred embodiments of the present invention, the section of the end tank or side in contact with the header is of greater width or breadth than the side at other areas of the header. This section of the end tank is often called a 'foot' or 'tank foot', and this term is common in the field of heat exchangers. Since the tank foot serves as a base or supporting section at the tank to header joint area, the tank foot, due to its shape and increased mass, allows the header to be bent on or 'crimped' on or to the end tank, in order to provide an intimate connection and, maintain a leak tight or leak proof seal necessary to prevent fluid escape from the interior of the tank.

Therefore, the present invention provides for, in its various embodiments, a heat exchanger assembly, with tank to header joints with seals, the seals normally produced to be permanent seals, having a core with a header; an end tank; a joint between the header and the end tank; a sealing means between the header and the end tank at the tank to header joint; and a means for detecting a temporary seal between the header and the end tank. The means for detecting a temporary seal, therefore, can form a positive leak path between the header and the end tank. In preferred embodiments, the means for detecting a temporary seal is a channel or groove on the header or the end tank. Also preferred is where the means for detecting a temporary seal is located on the interior surface of the header or end tank. The means for detecting a temporary seal may also be located on the header and the end tank.

Preferred sealing means may be made out of any material with appropriate elastomeric properties. In preferred embodiments, for example, the sealing means is made of a rubber or rubber-like material or of plastic or a plastic like material. Even more preferred is when the sealing means is a gasket. Since the sealing means, if improperly positioned or forming a temporary seal, shows a positive leak path in the present invention, in preferred embodiments with tank feet attached to headers, the means for detecting a temporary seal preferably extends from the tank foot to the internal liquid containing environment of the tank in the area of the temporary seal.

DESCRIPTION OF THE PREFERRED EMBOIDMENTS

As described above and herein below, the means for detecting an inappropriate, incomplete or temporary seal, in accordance with an aspect of the present invention, may consist of modifications, deformations, perforations, cut-outs, scratches or the like, that serve as 'channels' or 'grooves' in the header or end tanks, preferably in the end tank, or in the end tank and header. Therefore, the actual shape or orientation of the means can vary accordingly to how and where it is positioned or the header or end tank. The means for detecting temporary seals (detecting future potential leaks) provides for a positive leak path in the case that the sealing means or gasket is misaligned or improperly positioned in the tank to header joint.

In a preferred embodiment of the present invention, a positive leak path is formed by a channel or groove located on an end tank. Preferred is where a plurality of channels or grooves is located on the end tanks. Also preferred is where a positive leak path is formed by a channel or groove located on a portion of a header. Also preferred is a channel or groove on both the header and end tank. More preferred is where a plurality of channels or grooves is located around the inner perimeter of the end tank. Also more preferred is where a plurality of channels or grooves is located on the header. The plurality of channels or grooves must be found at the area of the tank to header joint. Even more preferred is where the plurality of channels or grooves on the header or the end tank is at the majority of locations possible, or, more preferably, at every location where concern about the leak tight nature of the end tank to header joint is suspected or warranted.

In preferred embodiments of the present invention, a seal is formed at the end tank to header joint. The material to form a seal is preferably made of an elastomeric substance, such as rubber or rubber like substance or material or a plastic like substance or material, or any other substance or material where the characteristics necessary for manufacture and functionability, such as elasticity and resilience, as well as thermal and pressure and chemical resistance, are present. Also, preferred materials have characteristics to withstand conditions of temperature, pressure, chemical and other conditions, for the normal lifetime of the heat exchanger. A common form of seal with such properties is a gasket. Preferred embodiments of the present invention, therefore have sealing means comprising a gasket, (or other form, material) which, when placed in the tank to header joint, particular at the tank foot of the tank to header joint, forms a leak proof seal. More preferred for vehicle heat exchanger use is a gasket.

Figure 1A:
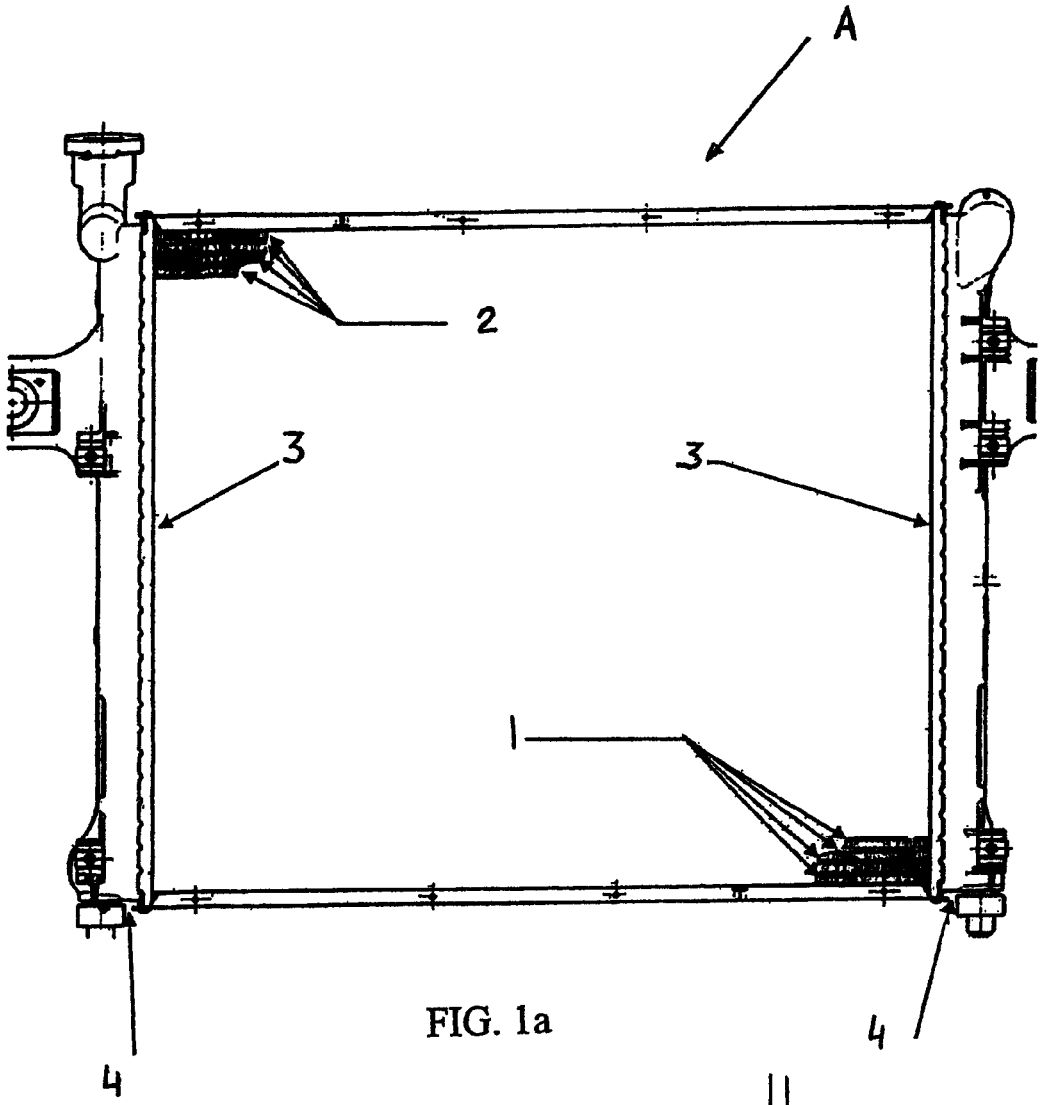
FIG. 1a PRIOR ART
FIG. 1 is a schematic representation of a heat exchanger comprising a core including headers and end tanks as found in the prior art.
Figure 1B:
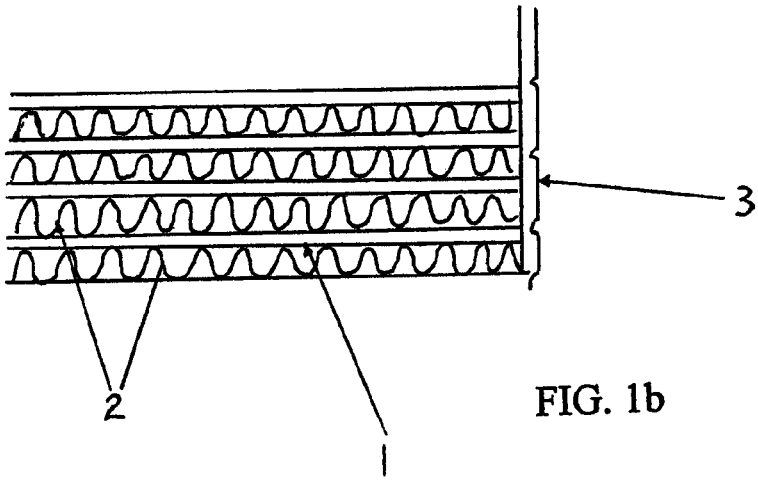
Figure 2:
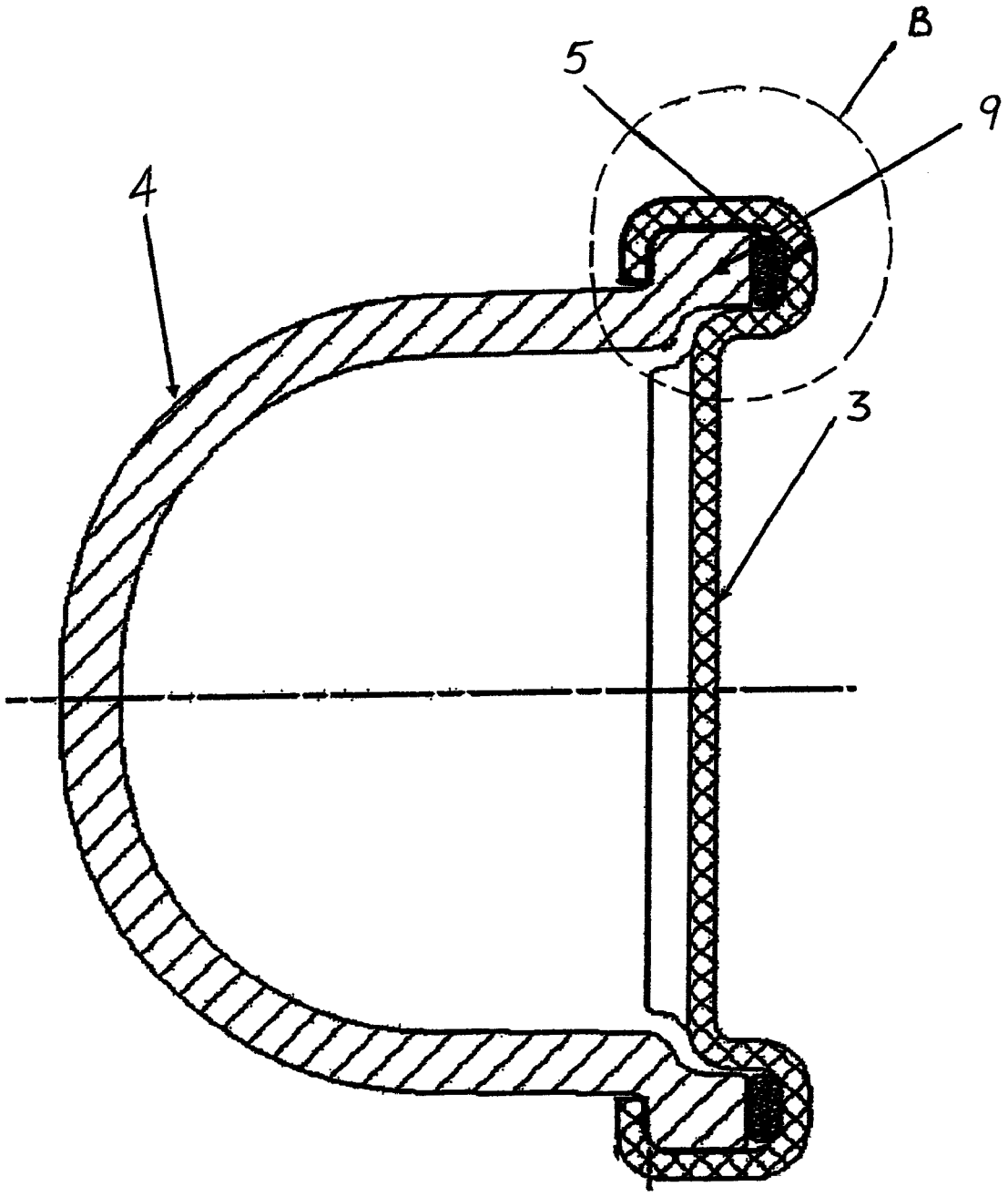
FIG. 2 PRIOR ART
FIG. 2 is a schematic representation of cross-section of the header, tank and gasket of a heat exchanger as found in the prior art.
Figure 3:
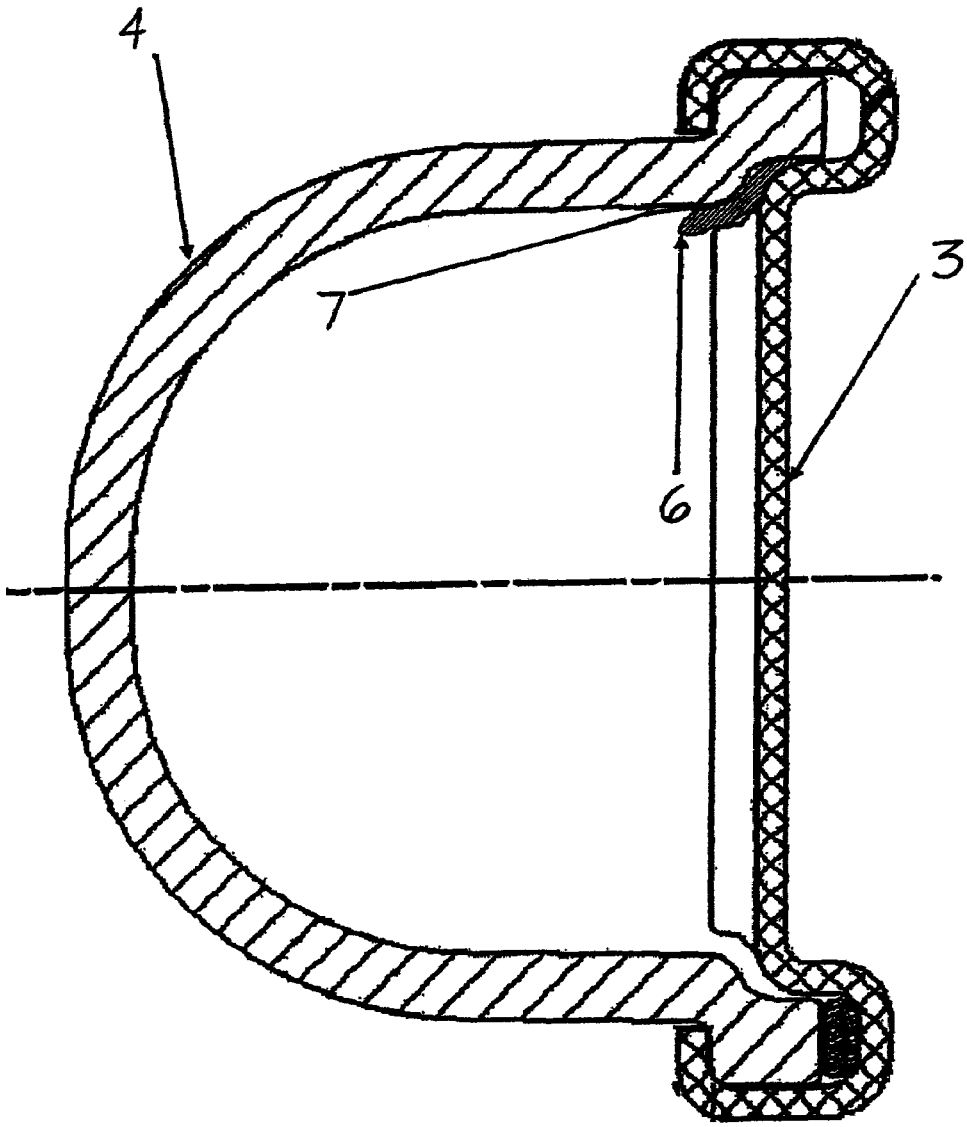
FIG. 3 PRIOR ART
FIG. 3 is a schematic representation of cross-section of header, tank and gasket of a heat exchanger wherein the gasket is misaligned or mal-positioned, but wherein a temporary seal is formed, as found in the problems of the prior art.
Figure 6A:
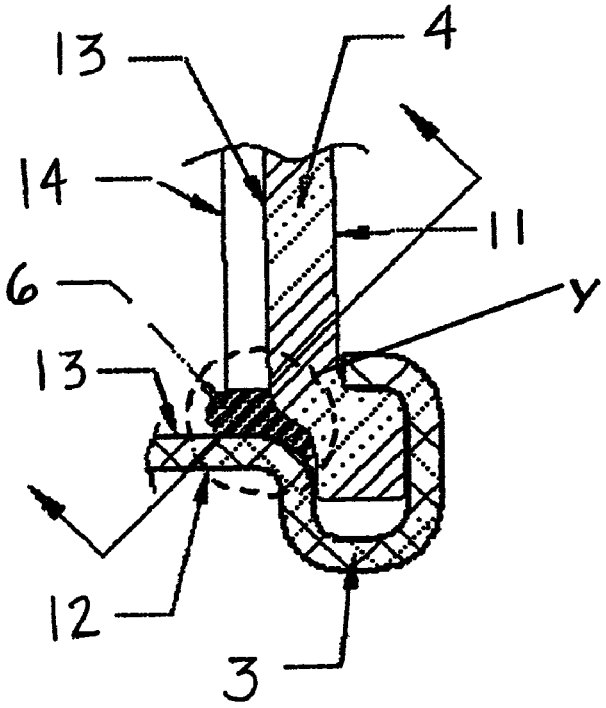
FIGS. 6*a* and 6*b* are two schematic cross-sectional representations of a tank with tank foot, and header, wherein a temporary seal is present due to misalignment of the gasket, as found in the problems of the prior art.
Figure 6B:
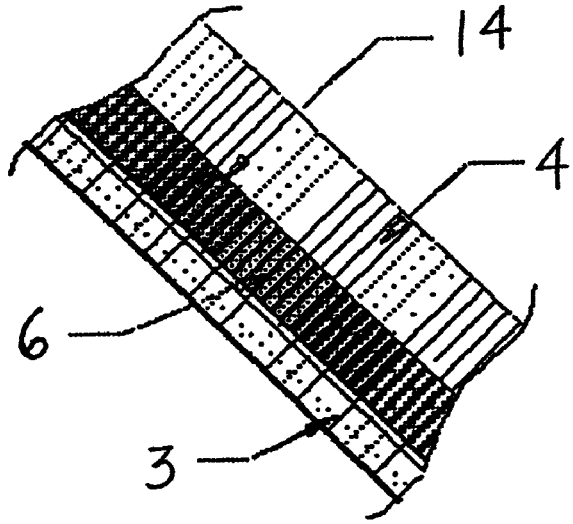
FIG. 6b PRIOR ART

Regarding FIGS. 1-3 and 6*a* and 6*b*, a heat exchanger A is shown, having fins or separators 2, headers 3, and end tanks 4. The core consists of tubes 1 and separators 2. FIG. 2 shows a cross section of a tank and header joint B, comprising the end tank 4, gasket 5 and header 3, the gasket positioned between the end tank 4 and the header 3 at the tank foot 9. FIG. 3 further shows the area of a temporary seal 7 and misaligned or mal-positioned gasket 6 as common in the prior art. FIGS. 6*a* and 6*b* show a misplaced gasket (misaligned) gasket 6, with the solution of an internal rib 14 to prevent movement from outside area Y in case of misalignment (as known in the prior art). The position of gasket 6 between the rib 14 and the inner surface 13 of the header 3, still allows for damage to the gasket with potential premature leakage at the joint during the normal lifetime of the heat exchanger tank assembly.

Figure 4:
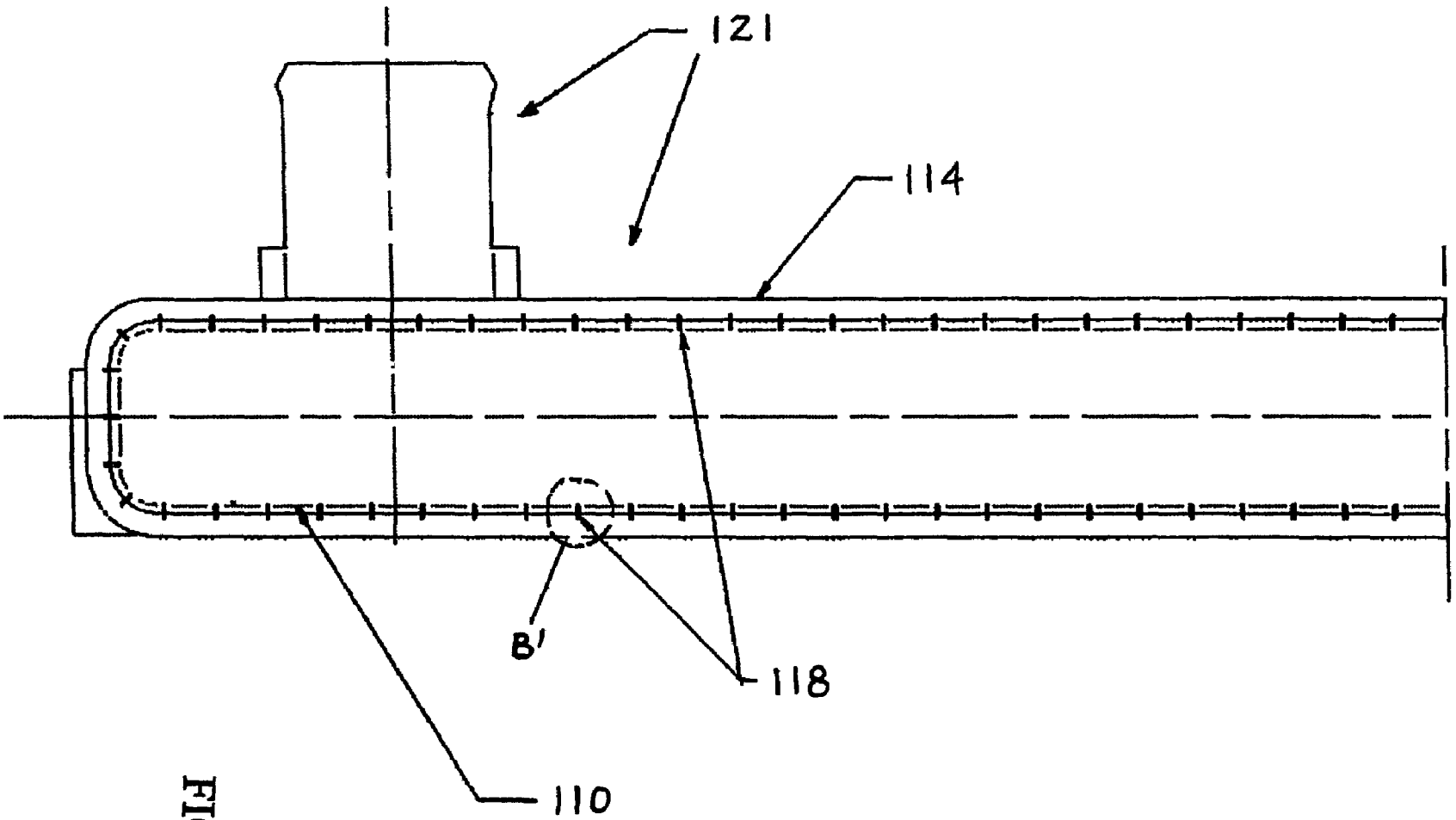
FIG. 4 is a schematic representation of an end tank comprising channels or grooves located at the areas of end tank to header joints in accordance with an aspect of the present invention.
Figure 5:
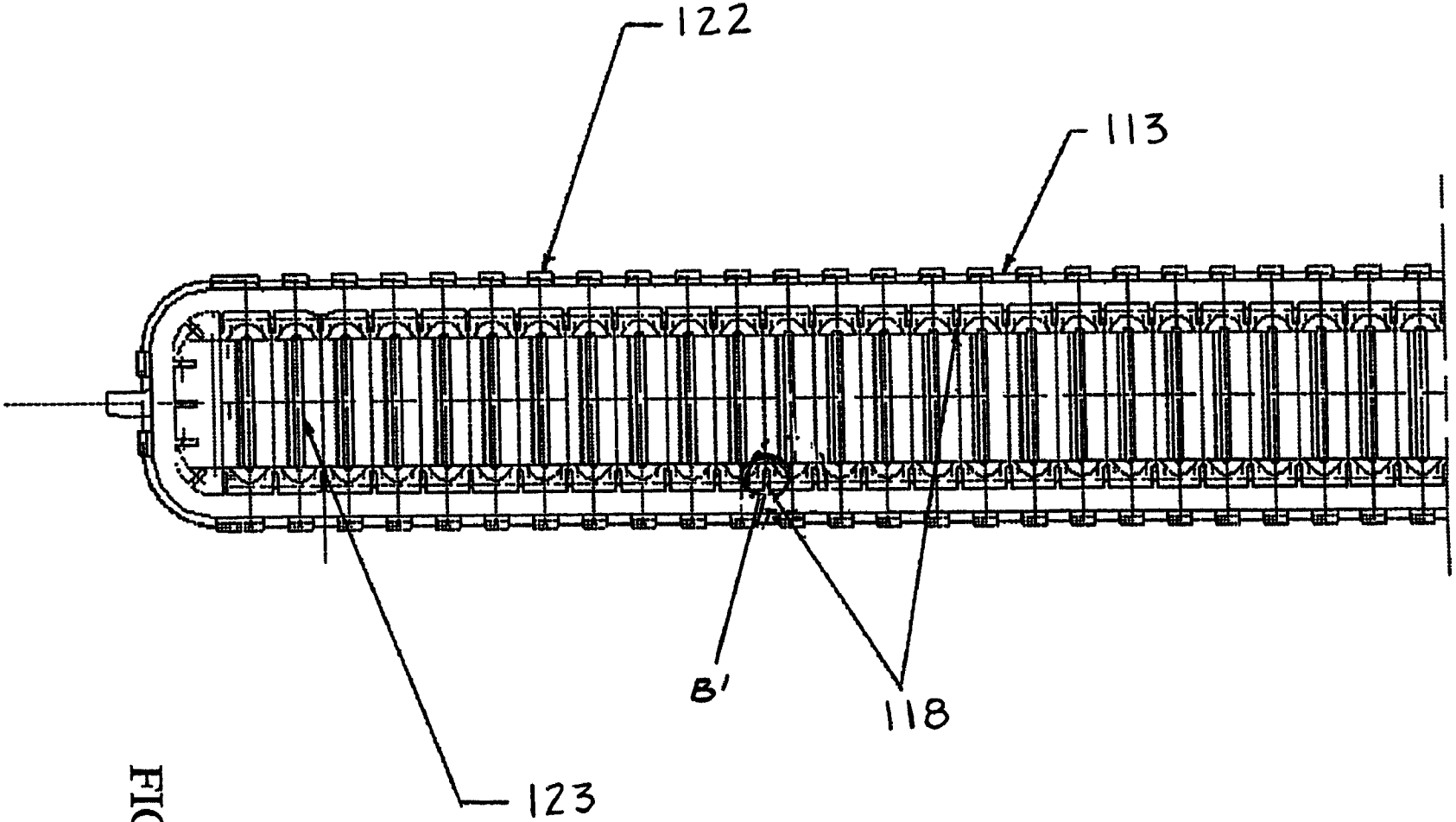
FIG. 5 is a more detailed schematic of a header comprising channels or grooves located at the areas of end tank to header joints in accordance with an aspect of the present invention.

In FIG. 4, an end tank 114 of the heat exchanger assembly as shown, with the interior surface 110 and exterior surface 121 of the end tank 114 illustrated. At the tank to header joint area B', a means for detecting temporary joints, e.g. a groove or channel 118, is provided, providing for a positive leak path. FIG. 5 further shows the exterior surface 122 of the header 113, and the interior header surface 123. The grooves or channels 118 form positive leak paths to detect temporary seals in the tank to header joint area B'.

Figure 7A:
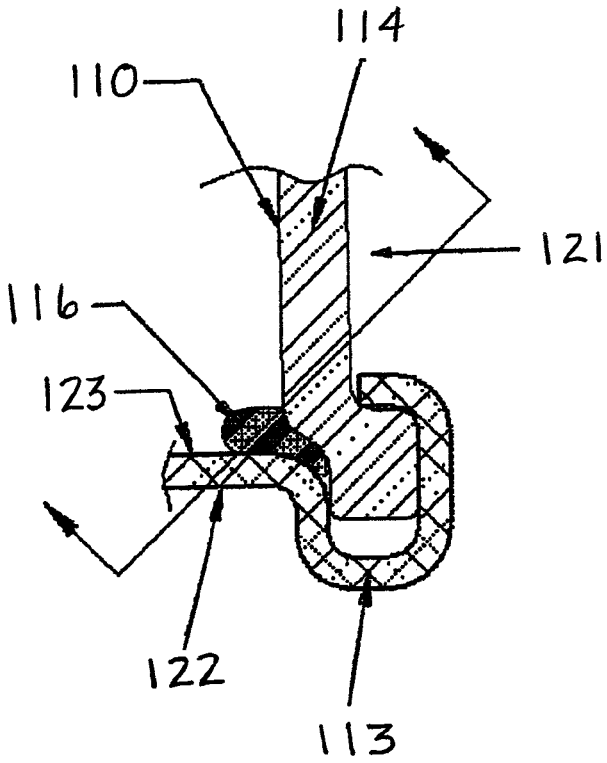
FIGS. 7*a* and 7*b* are schematic cross-sectional representations of a tank with tank foot, wherein the cross sectional 'cut' is in between two positive leak paths, in accordance with an aspect of the present invention.
Figure 7B:
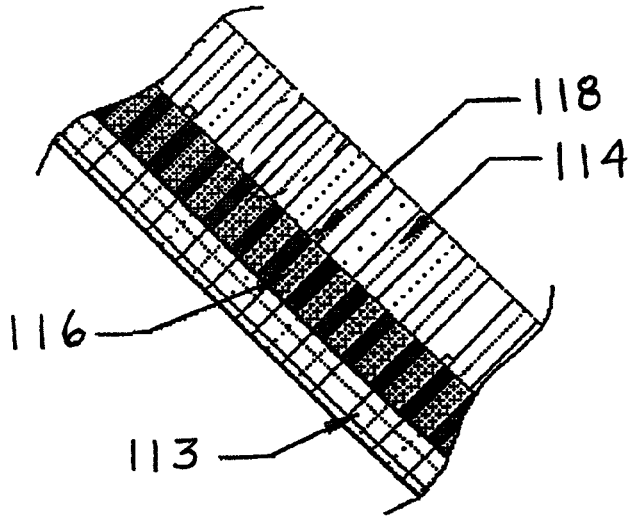

FIGS. 7*a* and *b* show both a cross-section and cut-away view of the tank to header joint area where the present invention solves the temporary seal detection problem. The inside surface 110 of the tank 114, is shown, with gasket 116 improperly placed between the header foot 114 and the inner surface 123 of the header 113. FIG. 7 *b* shows the gasket and the groove or channel 118, on the inner surface 110 of the tank 114.

Figure 8A:
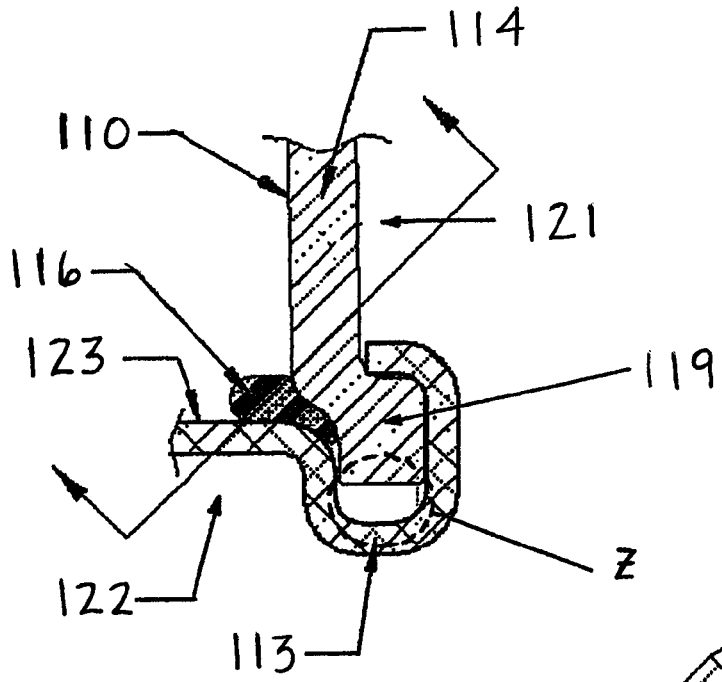
FIGS. 8*a* and 8*b* are schematic cross-sectional representations of a tank with tank foot, channels or grooves in both the header and in the end tank, in accordance with an aspect of the present invention.
Figure 8B:
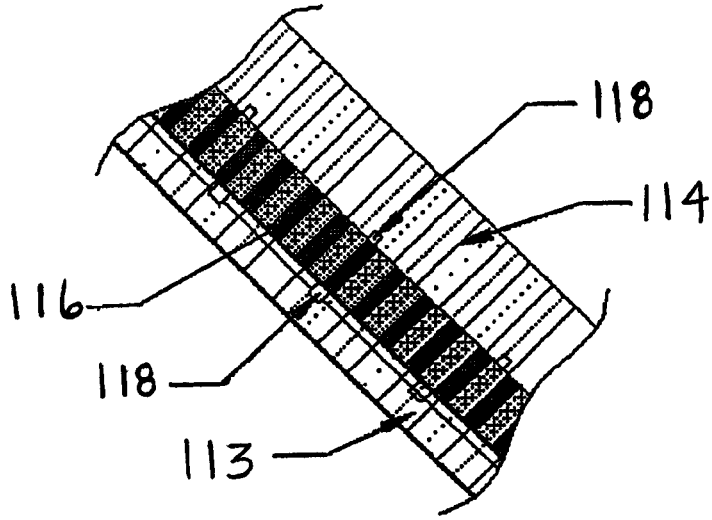

FIGS. 8*a* and 8*b* show the tank 114, with tank foot 119, the exterior surface 121 of the end tank 114 and the interior surface 110 of the tank. Gasket 116 is positioned away from its normal properly positioned location Z. Grooves or channels 118, are located on end tank 114 and the header 113, to detect the misaligned or misplaced sealing means.

Figure 9A:
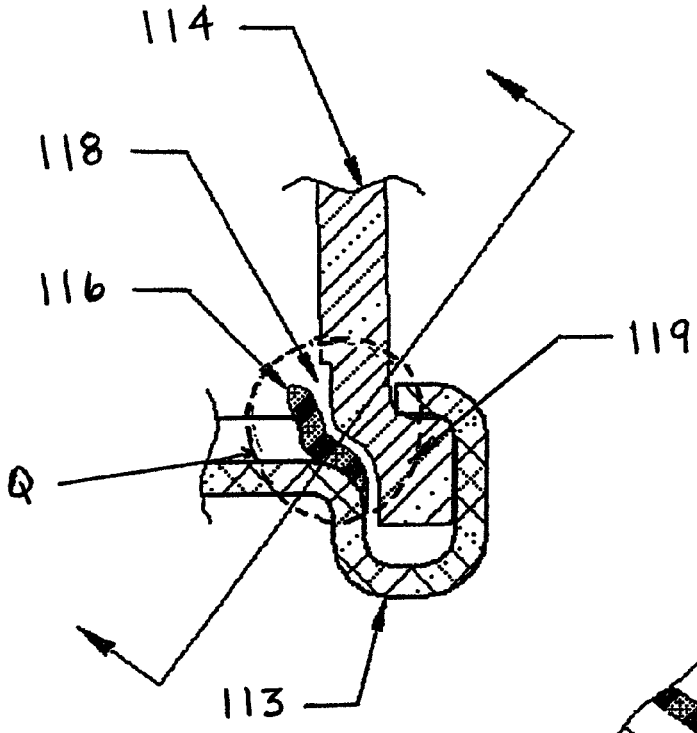
FIGS. 9*a* and 9*b* are schematic cross sectional representations wherein is depicted a header, tank and gasket of a heat exchanger (wherein the gasket is misaligned or mal-positioned, but wherein a temporary seal may be formed) through one of the positive leak paths, in accordance with an aspect of the present invention.
Figure 9B:
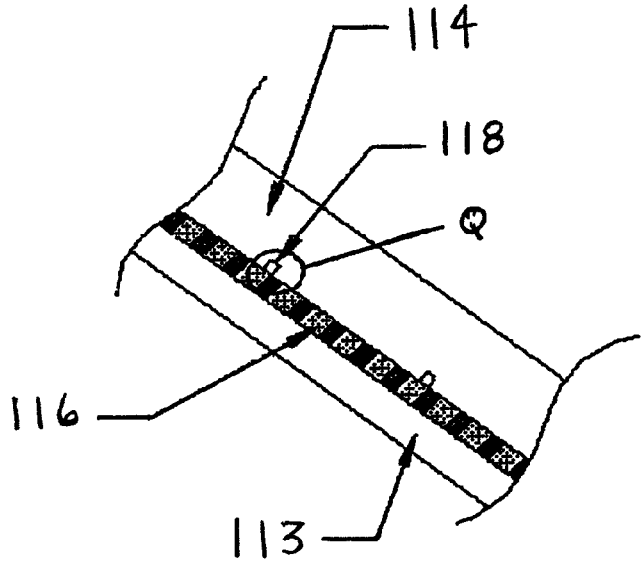

FIGS. 9*a* and 9*b* are shown with an end tank 114, with tank foot 119 having a misaligned gasket 116 between the header 113 and the foot 119. The grooves or channels 118 form a positive leak path to show failures, i.e. inappropriate, inadequate or incorrect seals (temporary seals) at the tank to header joint area Q.

Figure 10A:
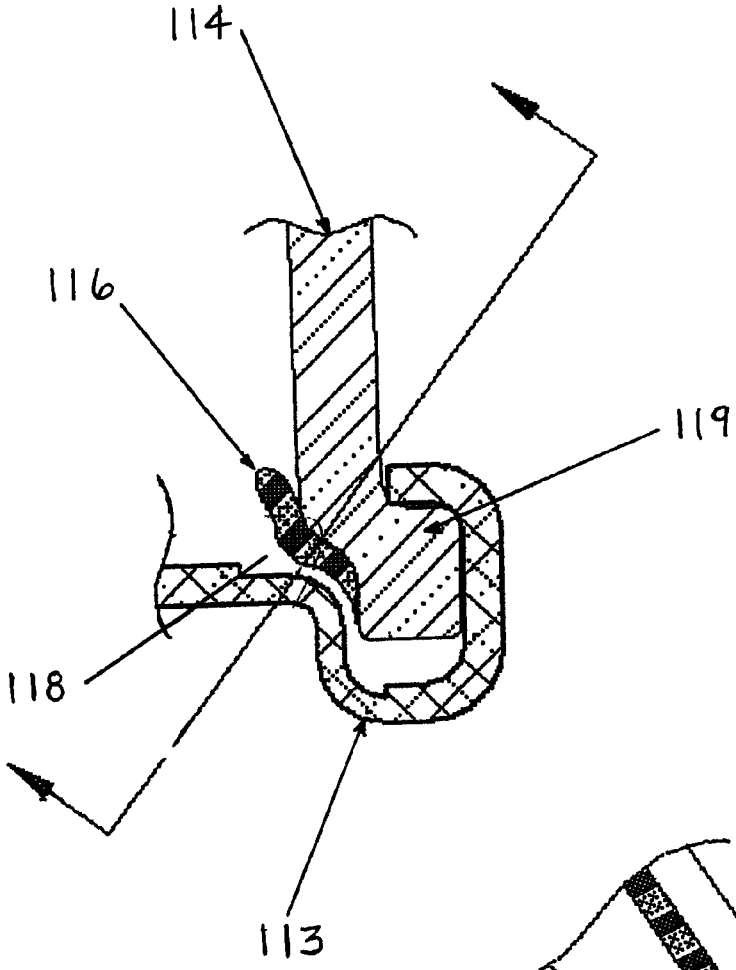
FIGS. 10*a* and 10*b* are schematic representations of cross-section of header, tank and gasket of a heat exchanger wherein the gasket is misaligned or mal-positioned, wherein when a temporary seal is formed, the cross sectional cut thorough one of the positive leak paths, in accordance with an aspect of the present invention.
Figure 10B:
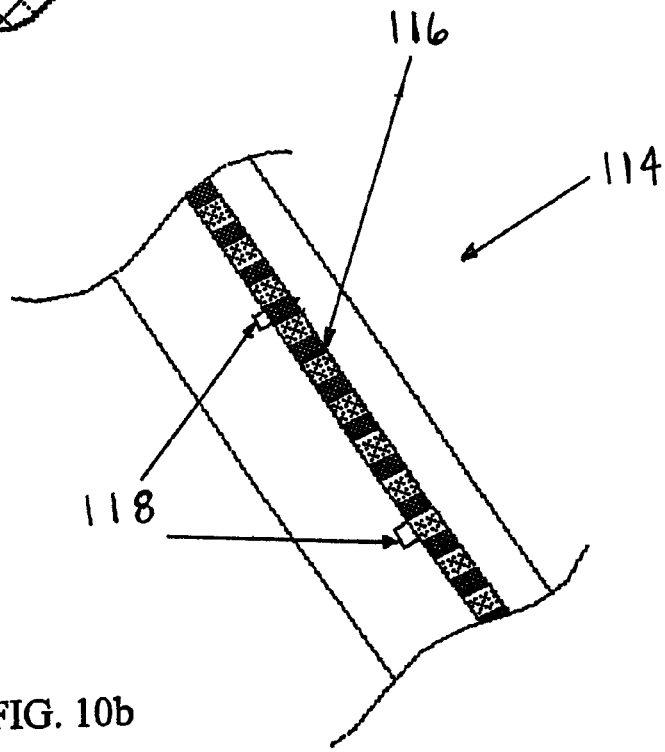

FIGS. 10*a* and 10*b* show another version of end tank 114, header 113 and misaligned gasket 116, wherein a means for detecting temporary seals, such as a groove or channel 118, is provided.

Figure 11A:
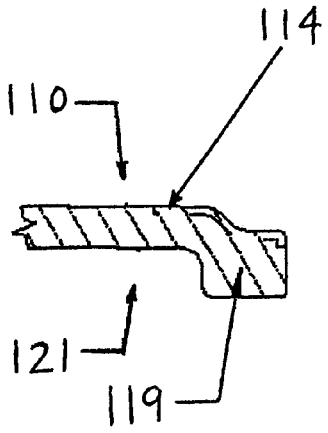
FIGS. 11*a*, 11*b* and 11*c* are schematic representations of the interior and exterior part of an end tank, and multiple configurations of means to detect temporary leaks, such as grooves or channels, forming positive leak paths, in accordance with an aspect of the present invention.
Figure 11B:
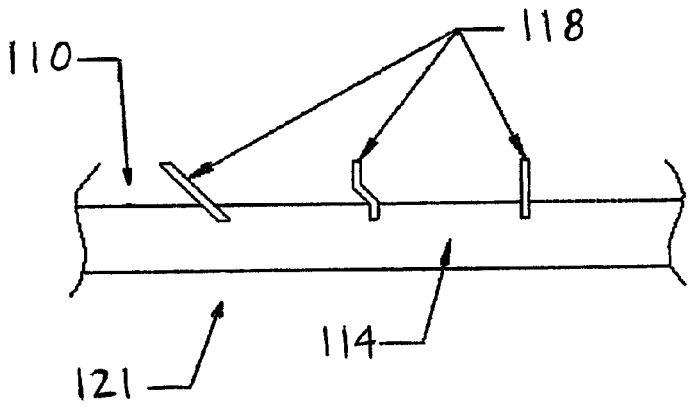
Figure 11C:
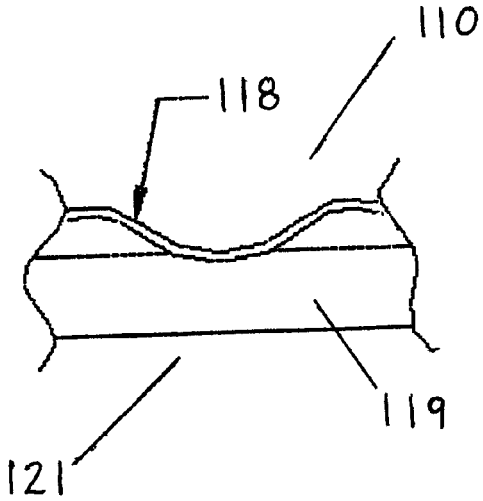

FIGS. 11*a, b* and *c* show multiple designs for means for detecting temporary seals, such as grooves and channels 118 of various shapes, such as straight, curved, sinusoidal, etc, end tank 114 or tank foot 119, or header and end tank, where the end tank or header grooves have designs that all provide for detection of inadequate, incorrect or inappropriate seals that diminish the normal lifetime of the heat exchanger assembly at the header to end foot joint area.

Figure 12:
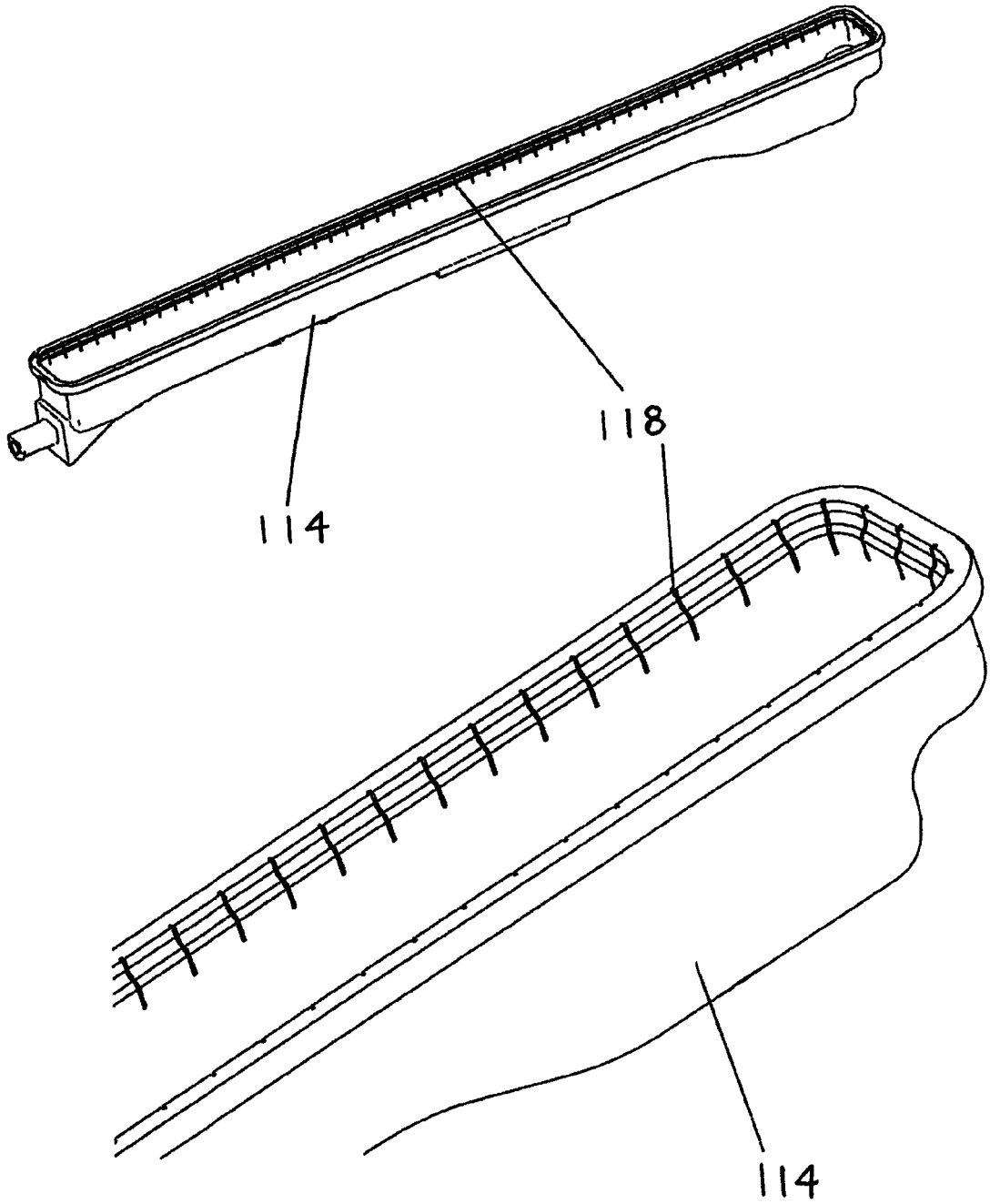
FIG. 12 is a perspective view of a heat exchanger end tank, with grooves on the tank, in accordance with an aspect of the present invention.

FIG. 12 shows a end tank 114, with grooves or channel 118 at the tank to header joint area.

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skill in the art would realize however, that certain modifications would come within the teachings of this invention. Therefore, the following claims should be studied to determine the true scope and content of the invention.

What is claimed is:

1. A heat exchanger assembly, comprising:

a core with a header;

an end tank;

a joint between the header and the end tank;

a sealing means between the header and the end tank in an area at the joint between the header and the end tank, the sealing means normally producing a permanent seal except when a misalignment of the sealing means at the joint between the header and the end tank produces a temporary seal; and at least one groove or channel on the header or the end tank at the joint between the header and the end tank for detecting the temporary seal, the at least one groove or channel extending beyond a highest point at which the temporary seal is formed;

wherein the at least one groove or channel functions as a positive leak path between the temporary seal and at least one of the header or the end tank in the area at the joint between the header and the end tank.

2. The heat exchanger assembly according to claim 1 wherein the at least one groove or channel is located on the interior surface of the header.

3. The heat exchanger assembly according to claim 1 wherein the at least one groove or channel is located on the interior surface of the end tank.

4. The heat exchanger assembly according to claim 2 wherein the sealing means is a gasket.

5. The heat exchanger assembly according to claim 3 wherein the sealing means is a gasket.

6. The heat exchanger assembly according to claim 1 wherein the at least one groove or channel is located on the header and at least one other groove or channel is located on the end tank.

7. The heat exchanger assembly according to claim 1, wherein the end tank further comprises a tank foot at the area of the tank to header joint.

8. The heat exchanger assembly according to claim 7 wherein the at least one groove or channel is on the end tank.

9. The heat exchanger assembly according to claim 7 wherein the sealing means is made of a rubber material or of a plastic material.

10. The heat exchanger assembly according to claim 9 wherein the sealing means is a gasket.

11. The heat exchanger assembly according to claim 10 wherein the at least one groove or channel extends from the tank foot to the internal liquid containing environment of the tank.

12. The heat exchanger assembly according to claim 2 wherein the sealing means is made of a rubber material or of a plastic material.

13. The heat exchanger assembly according to claim 3 wherein the sealing means is made of a rubber material or of a plastic material.

* * * * *